US009520086B2

(12) United States Patent
Bae et al.

(10) Patent No.: US 9,520,086 B2
(45) Date of Patent: Dec. 13, 2016

(54) DISPLAY APPARATUS, POWER VOLTAGE GENERATING APPARATUS, AND METHOD OF GENERATING POWER VOLTAGE

(71) Applicant: Samsung Display Co., Ltd., Yongin, Gyeonggi-Do (KR)

(72) Inventors: Jong-Man Bae, Yongin (KR); Byeong-Doo Kang, Yongin (KR); Jin-Woo Kim, Yongin (KR); Kyoung-Jin Park, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 293 days.

(21) Appl. No.: 14/249,319

(22) Filed: Apr. 9, 2014

(65) Prior Publication Data

US 2015/0130367 A1 May 14, 2015

(30) Foreign Application Priority Data

Nov. 11, 2013 (KR) ..... 10-2013-0136546

(51) Int. Cl.
*H05B 37/02* (2006.01)
*G09G 3/32* (2016.01)

(52) U.S. Cl.
CPC ..... *G09G 3/3233* (2013.01); *G09G 2330/02* (2013.01); *G09G 2330/028* (2013.01)

(58) Field of Classification Search
CPC ..... G09G 3/32; G09G 3/3208; G09G 3/3225; G09G 3/3275; G09G 3/3258; G09G 3/3233; G09G 2320/0257; G09G 2330/02; G09G 2330/028; H05B 33/0896
See application file for complete search history.

(56) References Cited

U.S. PATENT DOCUMENTS 4,835,423 A * 5/1989 de Ferron ..... H03K 17/693 327/436
4,952,885 A * 8/1990 Devecchi ..... H03F 3/345 330/277
6,509,895 B2 * 1/2003 Yanagi ..... H04N 3/127 345/204
2001/0004206 A1 6/2001 Buchschacher
2008/0180429 A1 * 7/2008 Park ..... G09G 3/3648 345/211

(Continued)

FOREIGN PATENT DOCUMENTS

KR 10-0894606 B1 4/2009
KR 10-2012-0030771 A 3/2012
KR 10-2013-0076293 A 7/2013

*Primary Examiner* — Lun-Yi Lao
*Assistant Examiner* — Elliott Deaderick
(74) *Attorney, Agent, or Firm* — Lewis Roca Rothgerber Christie LLP

(57) ABSTRACT

A power voltage generating apparatus supplies a power voltage to a plurality of pixel circuits of a display apparatus. The power voltage generating apparatus includes: a high voltage converter to generate a high voltage; a low voltage converter to generate a low voltage; a switching circuit to alternately output the high voltage and the low voltage at a power voltage terminal as the power voltage; and a discharging unit coupled to the power voltage terminal and configured to discharge the power voltage terminal until a voltage output is converted from the high voltage to the low voltage by using the switching circuit.

19 Claims, 9 Drawing Sheets

(56) References Cited

U.S. PATENT DOCUMENTS

| | | | | |
|---|---|---|---|---|
| 2009/0058311 | A1* | 3/2009 | Eom | G09G 3/3208 315/173 |
| 2009/0109147 | A1 | 4/2009 | Park et al. | |
| 2011/0012888 | A1* | 1/2011 | Ko | G09G 3/3648 345/212 |
| 2012/0069059 | A1 | 3/2012 | Lee | |
| 2013/0009566 | A1* | 1/2013 | Miyazaki | G09G 3/3696 315/287 |
| 2013/0127532 | A1 | 5/2013 | Huisman | |
| 2013/0169180 | A1 | 7/2013 | Park et al. | |
| 2014/0132322 | A1* | 5/2014 | Uno | H03K 3/3565 327/206 |

* cited by examiner

DISPLAY APPARATUS, POWER VOLTAGE GENERATING APPARATUS, AND METHOD OF GENERATING POWER VOLTAGE

CROSS-REFERENCE TO RELATED APPLICATION

This application claims priority to and the benefit of Korean Patent Application No. 10-2013-0136546, filed on Nov. 11, 2013, in the Korean Intellectual Property Office, the disclosure of which is incorporated herein in its entirety by reference.

BACKGROUND

1. Field

One or more embodiments of the present invention relate to a display apparatus, a power voltage generating apparatus, and a method of generating a power voltage.

2. Description of the Related Art

A display apparatus converts input data into an image by adjusting luminance of each of pixels by applying a data driving signal corresponding to the input data. A data driving signal to be output to a plurality of pixel circuits corresponding to the pixels, is generated by using a data driving unit. To this end, a display apparatus generates at least one power voltage to be supplied to the pixel circuits of the display apparatus, from a voltage supplied from an external power supply.

SUMMARY

One or more embodiments of the present invention include a display apparatus with improved power voltage supply characteristics.

One or more embodiments of the present invention include a power voltage supply apparatus including a discharge circuit that is capable of protecting a low-voltage supply source when a switching circuit alternately outputs a power voltage.

Additional aspects will be set forth in part in the description which follows and, in part, will be apparent from the description, or may be learned by practice of the presented embodiments.

According to one or more embodiments of the present invention, a power voltage generating apparatus for supplying a power voltage to a plurality of pixel circuits of a display apparatus, includes: a high voltage converter for generating a high voltage; a low voltage converter for generating a low voltage; a switching circuit for alternately outputting the high voltage and the low voltage at a power voltage terminal as the power voltage; and a discharging unit that is coupled to the power voltage terminal and configured to discharge the power voltage terminal until a voltage output is converted from the high voltage to the low voltage by using the switching circuit.

The discharging unit may include: a resistor coupled to the power voltage terminal; a transistor coupled between the resistor and a ground; and a gate driver coupled to a gate electrode of the transistor.

The gate driver may turn on the transistor for a period of time before a voltage output at the power voltage terminal is changed from a high voltage to a low voltage by using the switching circuit.

The voltage of the power voltage terminal may be discharged from a high voltage to a ground level during the period of time.

The transistor may include an NMOS transistor.

The resistor may include a variable resistor.

The switching circuit may include: first and second transistors coupled between the high voltage converter and the power voltage terminal; third and fourth transistors coupled between the low voltage converter and the power voltage terminal; a first gate driver that applies a first voltage to the first and second transistors; and a second gate driver that applies a second voltage to the third and fourth transistors.

The first through fourth transistors may include PMOS transistors.

The switching circuit may output the high voltage at the power voltage terminal when the first gate driver turns on the first and second transistors, and the second gate driver turns off the third and fourth transistors, and the switching may output the low voltage at the power voltage terminal when the first gate driver turns off the first and second transistors, and the second gate driver turns on the third and fourth transistors.

According to one or more embodiments of the present invention, a method of generating a power voltage supplied to a pixel unit of a display apparatus, includes: outputting a high voltage at a power voltage terminal, wherein the outputting is performed by a switching circuit, and a discharging unit coupled to the power voltage terminal is turned off; discharging a voltage of the power voltage terminal as the discharging unit is turned on; and outputting a low voltage at the power voltage terminal, wherein the outputting is performed by the switching circuit, and the discharging unit is turned off, wherein the switching circuit alternately outputs the high voltage and the low voltage as a power voltage, and the discharging unit is coupled to the switching circuit.

The discharging unit may include a resistor, a transistor coupled between the resistor and a ground, and a gate driver coupled to a gate electrode of the transistor, wherein when the transistor is turned on, the discharging unit is turned on, and when the transistor is turned off, the discharging unit is turned off.

The resistor may include a variable resistor, and a time used for the discharging operation may be varied according to a resistance value of the variable resistor.

The switching circuit unit may include: first and second transistors coupled between a high voltage converter and the power voltage terminal; and third and fourth transistors coupled between a low voltage converter and the power voltage terminal.

The outputting of the high voltage may include: turning on the first and second transistors, turning off the third and fourth transistors, and turning off the discharging unit; and turning off the first through fourth transistors, and turning off the discharging unit.

The outputting of the low voltage may include: turning off the first and second transistors, turning on the third and fourth transistors, and turning off the discharging unit; and turning off the first through fourth transistors, and turning off the discharging unit.

The discharging may include: turning off the first through fourth transistors and turning on the discharging unit; and turning off the first through fourth transistors, and turning off the discharging unit.

According to one or more embodiments of the present invention, a display apparatus includes: a plurality of pixel circuits, each including a storage capacitor that stores a voltage level of a data driving signal; a data driver that generates a data driving signal to output the data driving signal to the plurality of pixel circuits; a scanning driver that generates a scan signal to output the scan signal to the plurality of pixel circuits; and a power voltage generator that generates a power voltage applied to the storage capacitor to output the power voltage through a power voltage terminal, wherein the power voltage generator alternately outputs a high voltage and a low voltage at the power voltage terminal, and includes a discharging unit that discharges the power voltage terminal before an output voltage is changed from a high voltage to a low voltage.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
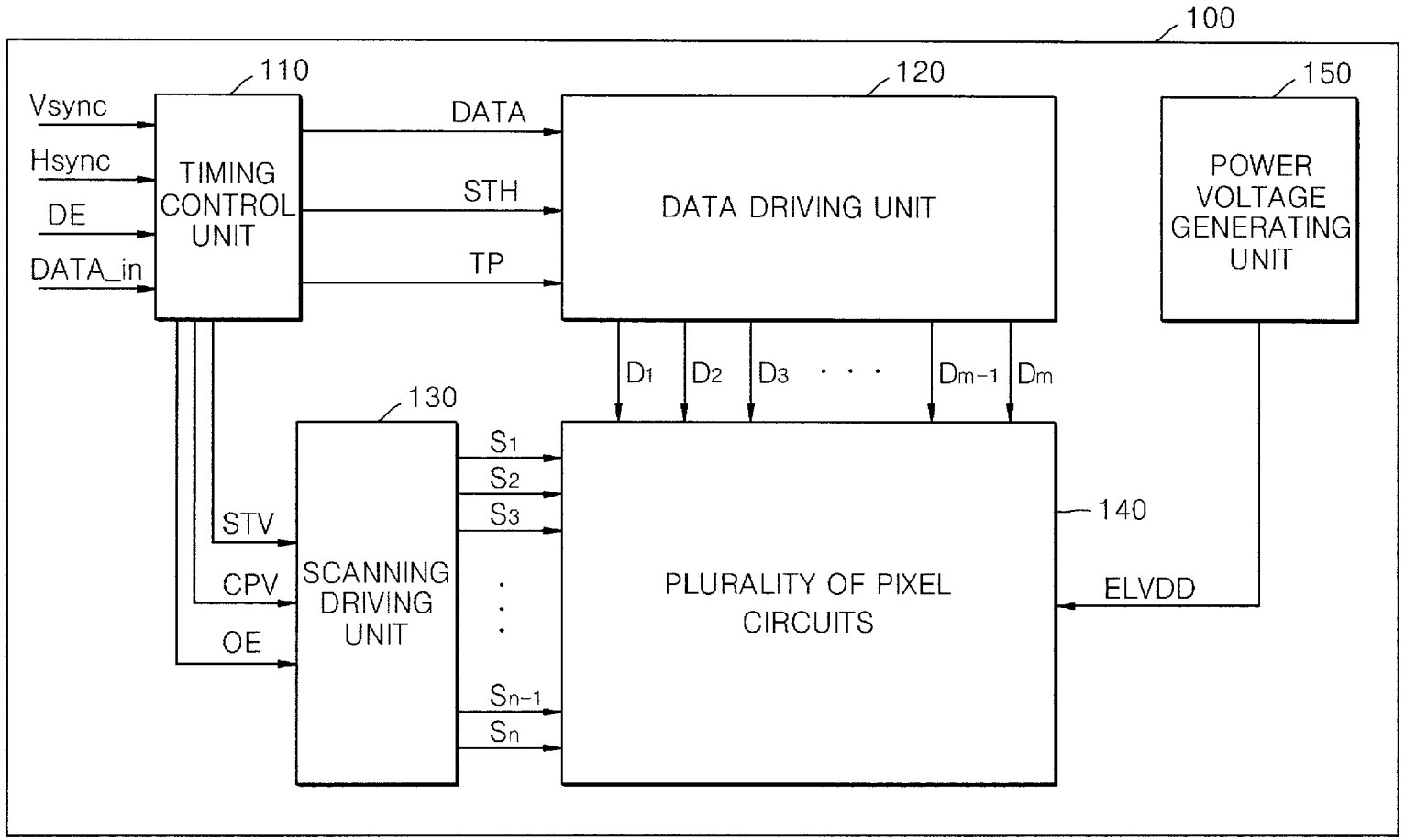
FIG. 1 is a schematic view illustrating a structure of a display apparatus according to an embodiment of the present invention.

Reference will now be made in detail to embodiments, examples of which are illustrated in the accompanying drawings, wherein like reference numerals refer to the like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items.

The present invention may be embodied in many different forms and should not be construed as being limited to the embodiments set forth herein. In the drawings, the sizes and thicknesses of constituent elements may be arbitrarily illustrated for convenience of description, and the present invention is not necessarily limited to the illustrations provided herein.

Hereinafter, the embodiments of the present invention will be described with reference to the attached drawings, and identical or corresponding elements will be labeled with like reference numerals and any redundant description thereof may be omitted.

According to the embodiments of the present invention below, terms such as "first" and "second" are used not for purposes of limitation but only for distinguishing one element from another element.

According to the embodiments of the present invention below, as used herein, the singular forms "a," "an," and "the," are intended to include the plural forms as well, unless the context clearly indicates otherwise.

According to the embodiments of the present invention below, it will be further understood that the terms "comprises," "comprising," "includes," and/or "including," when used herein, specify the presence of stated features and/or components, but do not preclude the presence or addition of one or more other features, and/or components thereof.

According to the embodiments of the present invention below, when a layer, an area, or an element is referred to as being "on" another layer, area, or element, it can be placed on or below the other layer, area or element, and it does not necessarily mean that the layer, area, or element is on the other layer, area, or element.

In the drawings, the sizes of components may be exaggerated or reduced for convenience of description. For example, a size or thickness of a component is illustrated for convenience of description, and the embodiments of the present invention are not necessarily limited to the illustration.

FIG. 1 is a schematic view illustrating a structure of a display apparatus 100 according to an embodiment of the present invention.

The display apparatus 100 includes a timing controller (e.g., a timing control unit) 110, a data driver (e.g., a data driving unit) 120, a scanning driver (e.g., a scanning driving unit) 130, a plurality of pixel circuits 140, and a power voltage generator (e.g., a power voltage generating unit or a power voltage generating apparatus) 150.

The timing controller 110 may receive a vertical synchronization signal Vsync, a horizontal synchronization signal Hsync, a data enable signal DE, and an image data signal DATA_in to output an RGB data signal DATA, which is obtained by converting the image data signal according to specifications of the data driver 120, to the data driver 120. Also, a data driving signal D1, D2, . . . DM may be output to the data driver 120 by generating a horizontal synchronization start signal STH and a load signal TP via which a reference timing for outputting a data driving signal from the data driver 120 to the plurality of pixel circuits 140 may be output to the data driver 120.

The timing controller 110 outputs a vertical synchronization start signal STV for selecting a first scan line, a gate clock signal CPV for sequentially selecting a next gate line, and an output enable signal OE for controlling output of the scanning driver 130, to the scanning driver 130.

The data driver 120 in the described embodiment is formed of a plurality of data driver ICs, and generates a data driving signal D1, D2, . . . , DM by receiving an RGB data signal DATA and a control signal STH and/or TP that are received from the timing controller 110, and outputs the data driving signals D1, D2, . . . , DM to respective data lines. The data driving signals D1, D2, . . . , DM are applied to the plurality of pixel circuits 140.

The scanning driver 130 in the described embodiment is formed of a plurality of scan driver ICs, and applies scanning signals S1, S2, . . . , SN to the respective scan line coupled to the plurality of pixel circuits 140, thereby sequentially scanning the plurality of pixel circuits 140 respectively coupled to the scan lines. For example, pixel circuits arranged along the same row may be coupled to the same scan line, and the scan lines may be sequentially driven.

The plurality of pixel circuits 140 may be driven by scan signals S1, S2, SN and data driving signals D1, D2, . . . , DM, thereby emitting light according to a voltage level of the data driving signals D1, D2, . . . , DM. The plurality of pixel circuits 140 may be arranged, for example, in an M×N secondary matrix (M and N are natural numbers). Also, each of the plurality of pixel circuits 140 may emit light by using an organic light emitting diode (OLED). A power voltage ELVDD and a cathode voltage ELVSS for driving the plurality of pixel circuits 140 are applied to the plurality of pixel circuits 140.

Each of the pixel circuits 140 may include a storage capacitor Cst for storing a voltage level of a respective one of the data driving signals D1, D2, . . . , DM. The storage capacitor Cst may store a voltage level of the data driving signal D1, D2, . . . , DM by using an anode power voltage ELVDD or a power voltage that is different from the anode power voltage ELVDD. A power voltage coupled to the storage capacitor Cst is referred to as a storage capacitor power voltage. In the present specification, description will focus on an embodiment in which the storage capacitor power voltage is equal to or substantially equal to the anode power voltage ELVDD. However, the embodiments of the present invention are not limited thereto, and the storage capacitor power voltage may alternatively be other power voltage that is different from the anode power voltage ELVDD.

Figure 2:
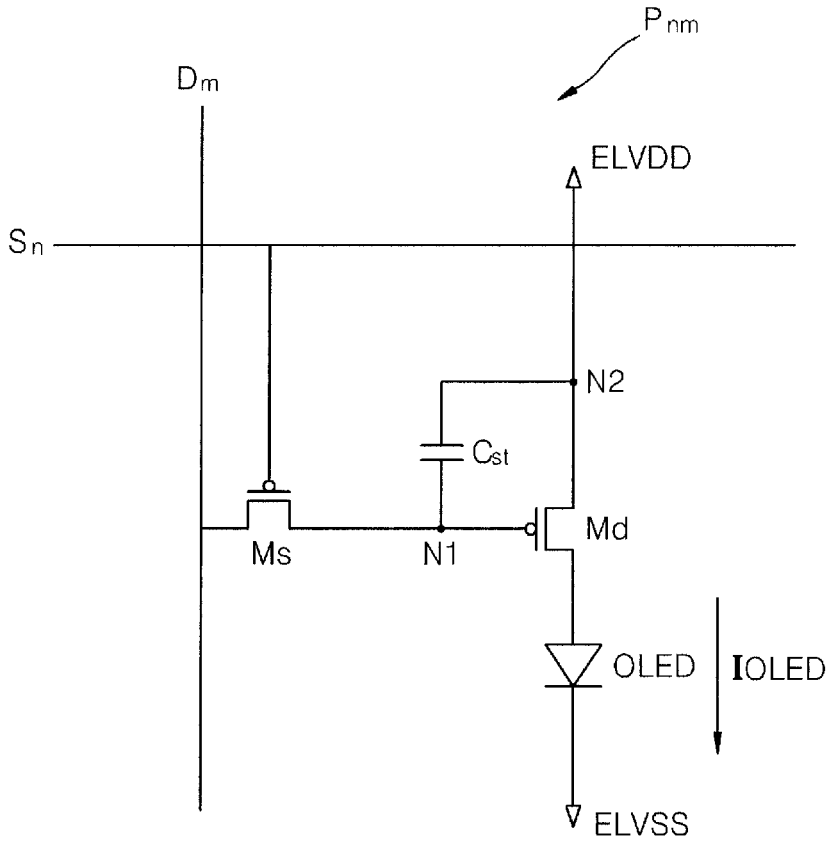
FIG. 2 illustrates one of a plurality of pixel circuits according to an embodiment of the present invention.

FIG. 2 illustrates one of a plurality of pixel circuits 140 according to an embodiment of the present invention.

A pixel circuit Pnm according to the described embodiment of the present invention may include a scan transistor Ms, a driving transistor Md, a storage capacitor Cst, and a light emitting diode OLED. When a scan signal Sn is activated (e.g., is at a logic low level), a data driving signal Dm is applied to a first node N1 through the scan transistor Ms. A voltage level corresponding to a data driving signal Dm and an anode power voltage ELVDD is stored in the storage capacitor Cst. In other words, the storage capacitor Cst stores a voltage difference between the anode power voltage ELVDD and the voltage level of the data driving signal Dm. The driving transistor Md generates a light emission current $I_{OLED}$ according to a voltage Vgs that is determined according to the voltage level stored in the storage capacitor Cst and outputs the same to the light emitting diode OLED. The light emitting diode OLED may be an organic light-emitting diode.

According to the embodiment of FIGS. 1 and 2, a power voltage ELVDD is generated by using the power voltage generator 150. The power voltage ELVDD for driving the light emitting device OLED in the described embodiment has different voltage levels for a data write section and a light emission section. For example, the power voltage generator 150 may output a low voltage as the power voltage ELVDD in the data write section, and output a high voltage as the power voltage ELVDD in the light emission section. Hereinafter, an embodiment of the present invention in which the power voltage generating unit 150 generates a power voltage ELVDD will be described.

Figure 3:
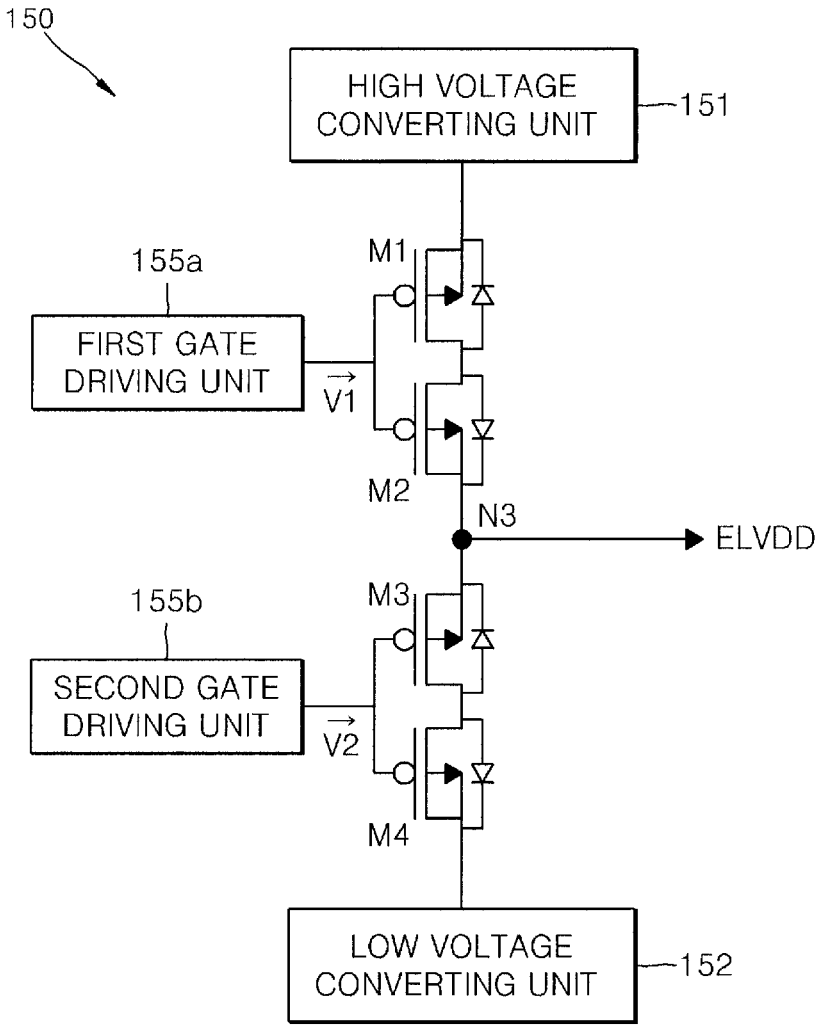
FIG. 3 illustrates a power voltage generator according to an embodiment of the present invention.

FIG. 3 illustrates an internal structure of the power voltage generator 150 according to an embodiment of the present invention.

Referring to FIG. 3, the power voltage generator 150 includes a high voltage converter (e.g., a high voltage converting unit) 151, a low voltage converter (e.g., a low voltage converting unit) 152, first and second transistors M1 and M2 coupled to a first gate driver (e.g., a first gate driving unit) 155*a*, and third and fourth transistors M3 and M4 coupled to a second gate driver (e.g., a second gate driving unit) 155*b*.

The high voltage converter 151 may generate a high voltage that is applied to the pixel circuits 140, and the low voltage generator 152 may generate a low voltage that is applied to the pixel circuits 140. The high voltage converter 151 or the low voltage converter 152 may include a DC-DC converter.

The first through fourth transistors M1, M2, M3, and M4 are coupled between the high voltage converter 151 and the low voltage converter 152. The first through fourth transistors M1, M2, M3, and M4 may be PMOS transistors. A source electrode of the first transistor M1 is coupled to the high voltage converter 151, and a drain electrode of the first transistor M1 is coupled to a drain electrode of the second transistor M2, and a gate electrode of the first transistor M1 is coupled to the first gate driver 155*a*.

A source electrode of the second transistor M2 is coupled to a source electrode of the third transistor M3 and a power voltage end (e.g., a power voltage terminal) N3, and a drain electrode of the second transistor M2 is coupled to the drain electrode of the first transistor M1, and a gate electrode of the second transistor M2 is coupled to the first gate driver 155*a*.

A source electrode of the third transistor M3 is coupled to a source electrode of the second transistor M2 and the power voltage end N3, and a drain electrode of the third transistor M3 is coupled to a drain electrode of the fourth transistor M4, and a gate electrode of the third transistor M3 is coupled to the second gate driver 155*b*.

A source electrode of the fourth transistor M4 is coupled to the low voltage converter 152, and a drain electrode of the fourth transistor M4 is coupled to the drain electrode of the third transistor M3, and a gate electrode of the fourth transistor M4 is coupled to the second gate driver 155*b*.

As the gate electrodes of the first transistor M1 and the second transistor M2 are coupled to the first gate driver 155*a*, they may operate in the same or substantially the same or similar manner. For example, when the first transistor M1 is in an ON state, the second transistor M2 is also in an ON state, and when the first transistor M1 is in an OFF state, the second transistor M2 is also in an OFF state. The same applies to the third transistor M3 and the fourth transistor M4 which are coupled to the second gate driver 155*b*. Thus, hereinafter, description of an ON or OFF state of the first transistor M1 and the fourth transistor M4 may also each apply to description of an ON or OFF state of the second transistor M2 and the third transistor M3.

The first gate driver 155*a* is coupled to the gate electrodes of the first transistor M1 and the second transistor M2 to apply a first voltage V1 that determines an ON or OFF state of the first transistor M1 and the second transistor M2. The second gate driver 155*b* is coupled to the gate electrodes of the third transistor M3 and the fourth transistor M4 to apply a second voltage V2 that determines an ON or OFF state of the third transistor M3 and the fourth transistor M4.

Figure 4:
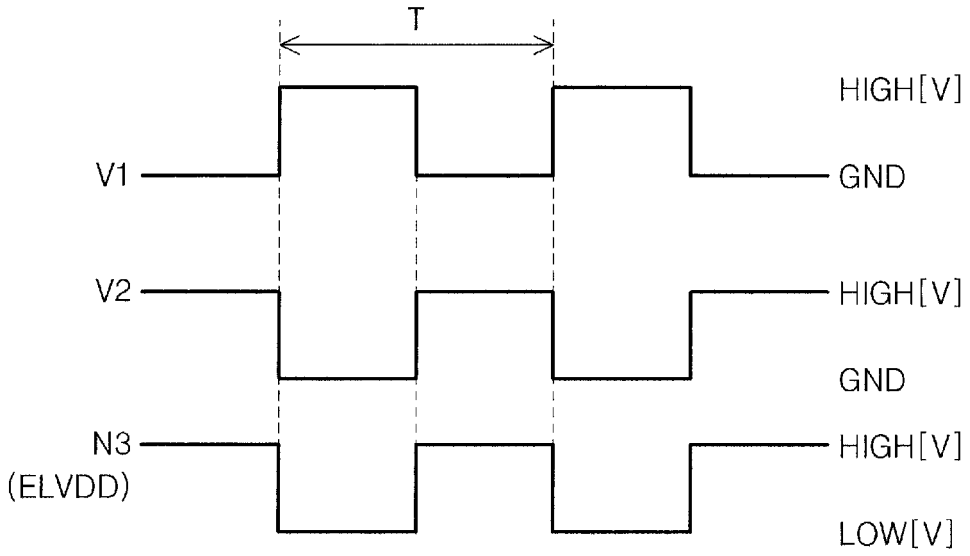
FIG. 4 illustrates a driving operation of the circuit of FIG. 3 according to an embodiment of the present invention.

FIG. 4 illustrates graphs of driving the circuit illustrated in FIG. 3 according to an embodiment of the present invention.

As shown in FIG. 4, in the circuit of FIG. 3, the first gate driver 155*a* and the second gate driver 155*b* respectively apply a first voltage V1 and a second voltage V2 alternately at a high level HIGH and a ground level (or low level) GND.

That is, during a period T, the first gate driver 155*a* and the second gate driver 155*b* may apply a second voltage V2 at a ground level GND when the first voltage V1 is at a high level HIGH, and a second voltage V2 at a high level HIGH when the first voltage V1 is at a ground level GND.

Although voltage levels such as a high level HIGH, a ground level GND, and a low level LOW are illustrated as voltage levels of a first voltage V1, a second voltage V2, and a power voltage ELVDD at a power voltage end N3 in the timing diagram of FIG. 4, these voltage levels indicate relative levels and not absolute voltage values. For example, the first and second voltages V1 and V2 at a high level HIGH and a ground level GND refer to critical voltage levels at which a transistor coupled to each gate driving unit (or gate driver) may be turned on or off but not absolute voltage values. Thus, voltage values of the high level HIGH and the ground level GND of the first and second voltages V1 and V2 may be different. Similarly, a voltage level of the first voltage V1 or the second voltage V2 at a high level HIGH and a voltage level of a power voltage ELVDD at a power voltage end N3 at a high level HIGH illustrated in FIG. 4 may be different. Also, a power voltage ELVDD at a power voltage end N3 at a high level HIGH may refer to a high voltage applied by using the high voltage converting unit 151, and a voltage at the power voltage end N3 at a low level LOW may refer to a low voltage applied by using the low voltage converter 152.

As illustrated in FIG. 4, when the first voltage V1 and the second voltage V2 are applied, a voltage output at the power voltage end N3 may be a high voltage when the second voltage V2 is at a high level HIGH, and may be a low voltage when the second voltage V2 is at a ground level GND.

In detail, when the first voltage V1 is at a high level HIGH, the first transistor M1 is in an OFF state, and when the second voltage V2 is at a ground level GND, the fourth transistor M4 is in an ON state, and thus, the power voltage end N3 is electrically coupled to the low voltage converter 152, and consequently, a voltage at a low level LOW is applied to the power voltage end N3. On the contrary, when the first voltage V1 is at a ground level GND, the first transistor M1 is in an ON state, and when the second voltage V2 is at a high level HIGH, the fourth transistor M4 is in an OFF state, and thus, the power voltage end N3 is electrically coupled to the high voltage converter 151, and consequently, a voltage at a high level HIGH is applied to the power voltage end N3.

When a circuit is configured in a manner as illustrated in FIGS. 3 and 4, when a power voltage ELVDD is converted from a high level HIGH to a low level LOW, a short circuit may be instantaneously caused between the power voltage end N3, to which a voltage at a high level HIGH is applied, and the low voltage converter 152. In this case, the DC-DC converter included in the low voltage converter 152 may be destroyed or an over-voltage protecting device (not shown) coupled to the circuit may operate to disable the entire circuit.

For example, as the fourth transistor M4 is in an ON state, a voltage at a low level LOW is to be applied to the power voltage end (e.g., the power voltage terminal) N3, but a voltage at a high level HIGH that is being output to the power voltage end N3 previously may be instantaneously shorted with respect to the low voltage converter 151 to cause a breakdown in the DC-DC converter included in the low voltage converter 151.

In order to solve this problem, according to an embodiment of the present invention, in order to prevent breakdown of the DC-DC converter included in the low voltage converter 152, a discharge circuit via which a voltage of the power voltage end N3 is dropped (e.g., dropped by a predetermined amount) before the voltage output to the power voltage end N3 is converted from a high voltage to a low voltage.

Figure 5:
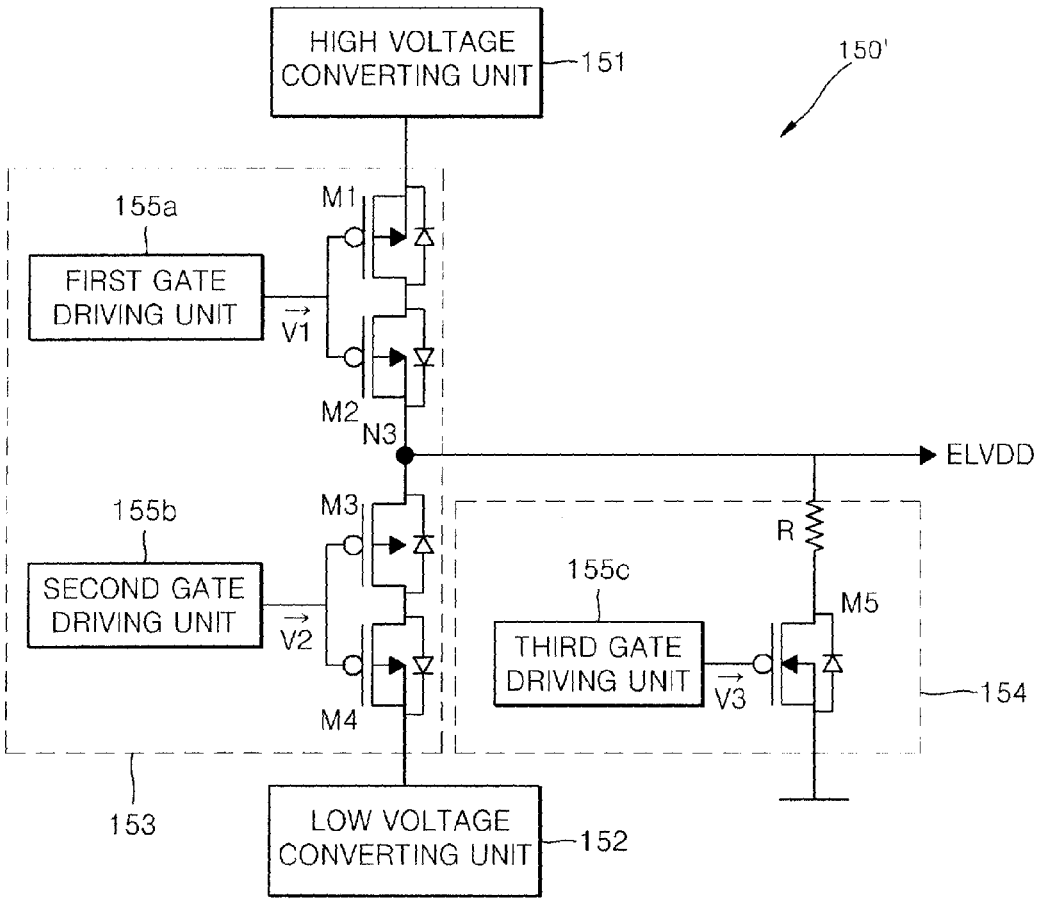
FIG. 5 illustrates an internal structure of a power voltage generator according to an embodiment of the present invention.

FIG. 5 illustrates an internal structure of a power voltage generator 150' according to an embodiment of the present invention. The power voltage generator 150', for example, may be used in place of the power voltage generator 150 of FIG. 1, according to an embodiment of the present invention.

A circuit of FIG. 5 included in the power voltage generator 150' includes a high voltage converter 151, a low voltage converter 152, a switching circuit 153, and a discharging unit 154. The power voltage generator 150' applies a voltage applied to a power voltage end N3 as a power voltage ELVDD, to the plurality of pixel circuits 140.

The high voltage converter 151 is a voltage source that is coupled to a source of the first transistor M1 and applies a high voltage to the power voltage end N3, and may include a DC-DC converter. The low voltage converter 152 is a voltage source that is coupled to a source of the fourth transistor M4 and applies a low voltage to the power voltage end N3, and may also include a DC-DC converter.

A high voltage applied by using the high voltage converter 151 is a voltage that is applied to the power voltage end N3 when a pixel circuit is in a light emission section (e.g., a light emission period or a light emission state), and a low voltage applied by using the low voltage converter 152 may be a voltage that is applied to the power voltage end N3 when a pixel circuit is in a data write section (e.g., a data write period or a data write state). Thus, the power voltage generator 150' includes a switching circuit for selectively outputting a high voltage applied by using the high voltage converter 151 and a low voltage applied by using the low voltage converter 152.

Consequently, a switching circuit 153 is coupled between the high voltage converter 151 and the low voltage converter 152. The switching circuit 153 may include the first gate driver 155*a*, the second gate driver 155*b*, and the first through fourth transistors M1, M2, M3, and M4 illustrated in FIG. 3. The switching circuit 153 may selectively and alternately output a high voltage and a low voltage to the power voltage end N3 as described above.

According to an embodiment of the present invention, the discharging unit 154 may be coupled to the power voltage end N3 in order to prevent a short circuit between the power voltage end N3, to which a high voltage is applied, and the low voltage converter 152, when a voltage applied to the power voltage end N3 is changed from a high voltage to a low voltage. The discharging unit 154 drops a voltage of the power voltage end N3 before a voltage output by using the switching circuit 153 is changed from a high voltage to a low voltage. The discharging unit 154 includes a resistor R, a fifth transistor M5, and a third gate driver (e.g., a third gate driving unit) 155*c* coupled to a gate electrode of the fifth transistor M5.

An end of the resistor R of the discharging unit 154 is coupled (e.g., directly coupled) to the power voltage end N3, and the other end of the resistor R is coupled (e.g., directly coupled) to a drain electrode of the fifth transistor M5. A source electrode of the fifth transistor M5 is coupled to a ground, and the drain electrode of the fifth transistor M5 is coupled to the other end of the resistor R, and the gate electrode of the fifth transistor M5 is coupled to the third gate driver 155*c*. The third gate driver 155*c* applies a third voltage V3 to the gate electrode of the fifth transistor M5.

Figure 6:
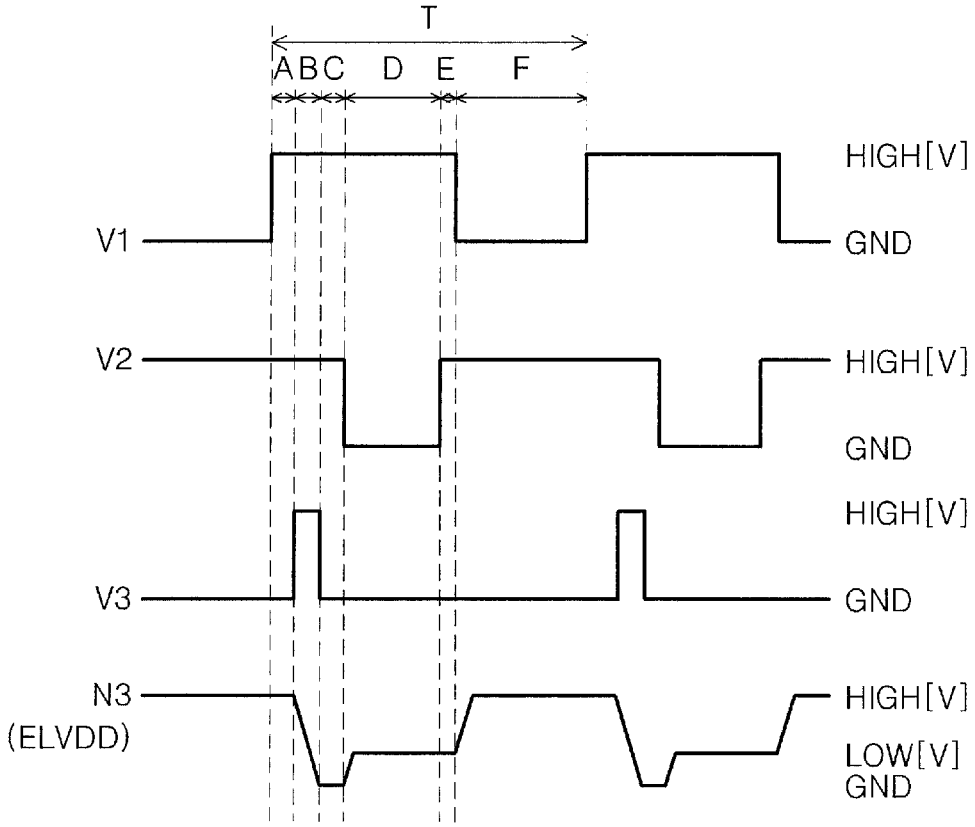
FIG. 6 illustrates a driving operation of the circuit of FIG. 5 according to an embodiment of the present invention.

FIG. 6 illustrates a driving operation of the circuit of FIG. 5 according to an embodiment of the present invention.

As has been described above with reference to FIG. 4, voltages at levels such as a high level HIGH, a low level LOW, and a ground level GND labeled in timing diagrams of the first through third voltages V1, V2, and V3 and the power voltage end N3 (ELVDD) are relative values and not absolute values. Also, a voltage of the power voltage end N3 at a high level HIGH may refer to a high voltage applied by using the high voltage converter 151, and a voltage at a low level LOW may refer to a low voltage applied by using the low voltage converter 152.

Referring to FIG. 6, first, in an initial state, the first gate driver 155*a* applies a first voltage V1 at a ground level GND, and the second gate driver 155*b* applies a second voltage V2 at a high level HIGH, and the third gate driver 155*c* applies a third voltage V3 at a ground level GND. In this case, the first transistor M1 is in an ON state, and the fourth transistor M4 and the fifth transistor M5 are in an OFF state, and accordingly, a voltage at a high level HIGH is output at the power voltage end N3.

Next, in a section A (e.g., a period A), the first gate driver 155*a* applies a first voltage V1 at a high level HIGH, and the second gate driver 155*b* applies a second voltage V2 at a high level HIGH, and the third gate driver 155*c* applies a third voltage V3 at a ground level GND. In the section A, the first transistor M1, the fourth transistor M4, and the fifth transistor M5 are all in an OFF state, and an output of the power voltage end N3 maintains a high level HIGH.

In a section B (e.g., a period B), outputs of the first gate driver 155*a* and the second gate driver 155*b* are maintained, and the third gate driver 155*c* applies a third voltage V3 at a high level HIGH. When applying the third voltage V3 at a high level HIGH, the fifth transistor M5 is turned on to be in an ON state, and discharging via the resistor R starts. Consequently, the power voltage ELVDD which is at a high level HIGH starts to gradually decrease to be discharged up to a ground level GND.

In a section C (e.g., a period C), outputs of the first gate driver 155*a* and the second gate driver 155*b* are maintained, and the third gate driver 155*c* applies the third voltage V3 again to a ground level GND. In this case, the first transistor M1, the fourth transistor M4, and the fifth transistor M5 are all in an OFF state, and an output of the power voltage end N3 maintains a ground level GND.

In a section D (e.g., a period D), the first gate driver 155*a* applies a first voltage V1 at a high level HIGH, and the second gate driver 155*b* applies a second voltage V2 at a ground level GND, and the third gate driver 155*c* applies a third voltage V3 at a ground level GND. In the section D, the first transistor M1 is in an OFF state, the fourth transistor M4 is in an ON state, and the fifth transistor M5 is in an OFF state, and an output at the power voltage end N3 is at a low level LOW.

In a section E (e.g., a period E), the first gate driver 155*a* applies a first voltage V1 at a high level HIGH, and the second gate driver 155*b* applies a second voltage V2 at a high level HIGH, and the third gate driver 155*c* applies a third voltage V3 at a ground level GND. In the section E, the first transistor M1, the fourth transistor M4, and the fifth transistor M5 are all in an OFF state, and an output of the power voltage end N3 maintains a low level LOW.

In a section F (e.g., a period F), the above-described initial state is output. That is, in the section F, the first gate driver 155*a* applies a first voltage V1 at a ground level GND, and the second gate driver 155*b* applies a second voltage V2 at a high level HIGH, and the third gate driver 155*c* applies a third voltage V3 at a ground level GND. In the section F, the first transistor M1 is in an ON state, and the fourth transistor M4 and the fifth transistor M5 are in an ON state, and thus, a voltage at a high level HIGH is output at the power voltage end N3.

In the above-described manner, the sections A through F are repeated during a period T, and a high voltage at a high level HIGH and a low voltage at a low level LOW may be alternately applied to the power voltage end N3. According to an embodiment of the present invention, an output of the power voltage end N3 does not immediately change from a high level HIGH to a low level LOW but undergoes a discharging process by using the discharging unit 154 in the section B, and accordingly, stability of the circuit may be increased (in comparison to when the discharging unit 154 is not used).

Figure 7:
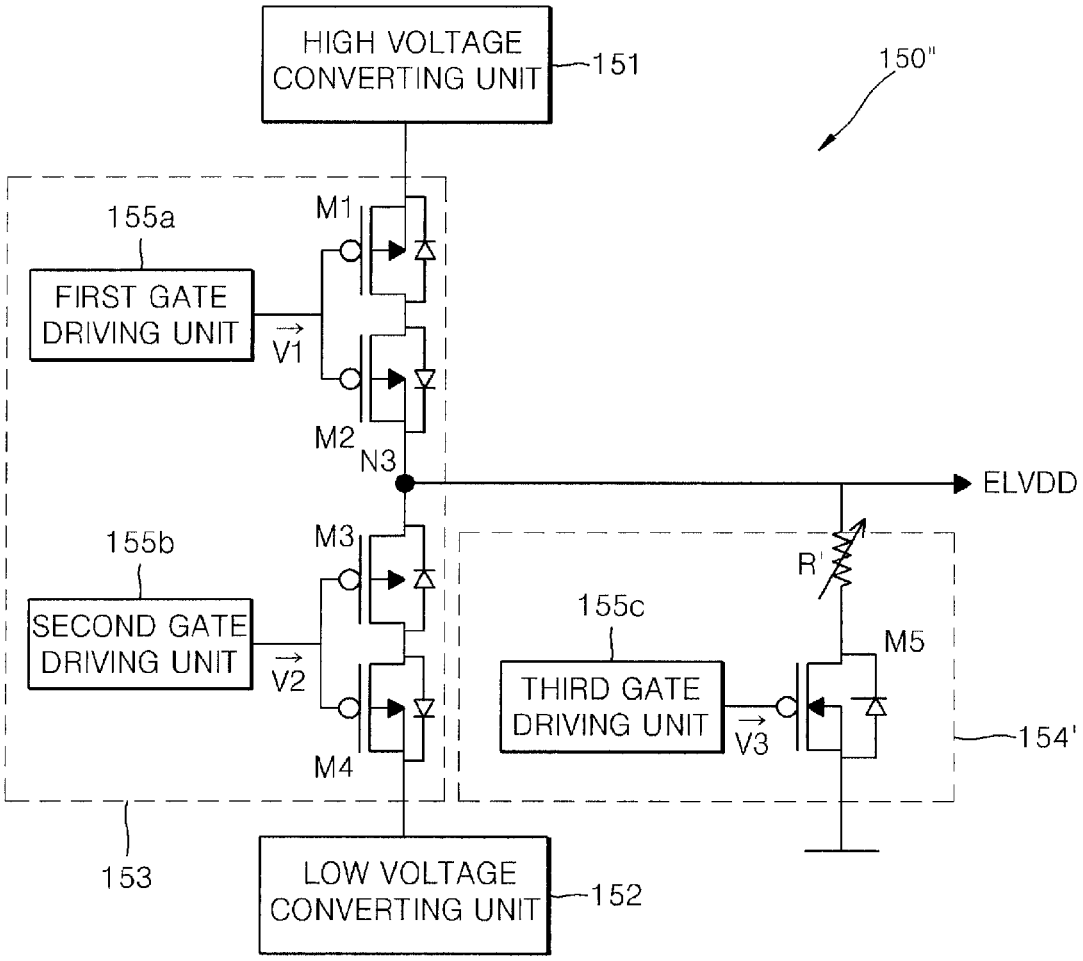
FIG. 7 illustrates an internal structure of a power voltage generator according to another embodiment of the present invention.

FIG. 7 illustrates an internal structure of the power voltage generator 150" according to another embodiment of the present invention. The power generator 150", for example, may be used in place of the power generator 150 of FIG. 1, according to another embodiment of the present invention.

The embodiment of FIG. 7 is a modified example of the embodiment of FIG. 5. Description that is already provided with reference to FIG. 5 may not be repeated.

Referring to FIG. 7, a resistor R' of the discharging unit 154' is a variable resistor. When a resistance value is adjusted by using the variable resistor R', a voltage value of the power voltage end N3 after being discharged by using the discharging unit 154' may be adjusted.

Figure 8:
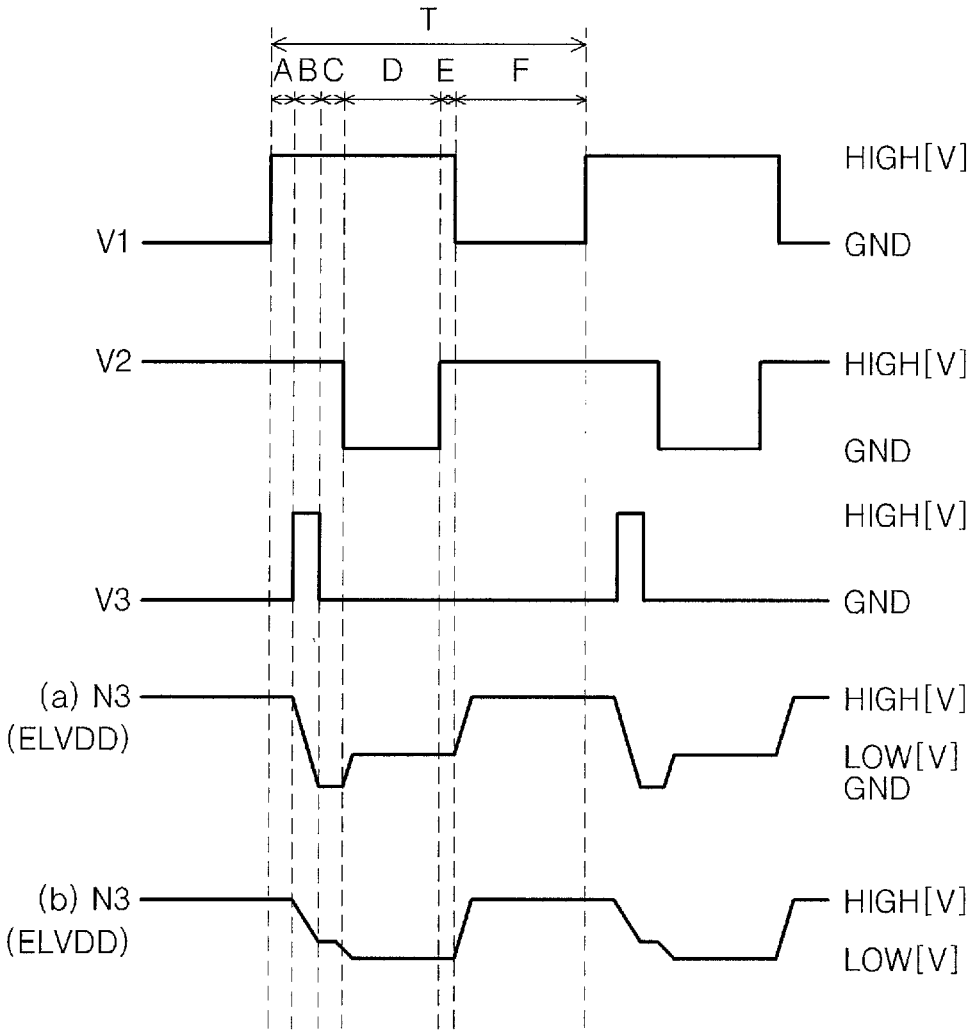
FIG. 8 illustrates a driving operation of the circuit of FIG. 7 according to another embodiment of the present invention.

FIG. 8 illustrates a driving operation of the circuit of FIG. 7 according to another embodiment of the present invention.

Referring to a timing diagram (a) of FIG. 8 which is a fourth timing diagram and a voltage diagram of the power voltage end N3, a variable resistance of the circuit of FIG. 7 is greater than that in a timing diagram (b) which is a fifth timing diagram and a voltage diagram of the power voltage end N3. That is, a value of the variable resistor R' is greater in the timing diagram (a) than in the timing diagram (b). Voltage values of the rest of the diagrams may have the same values as those of the corresponding diagrams of FIG. 6. Further, the value of the variable resistor R' corresponding to the timing diagram (a) may be the same or substantially the same as that of the resistor R of FIG. 5.

In the timing diagram (a) of the power voltage end N3 of FIG. 8, a voltage of the power voltage end N3 drops down to a ground level GND after passing through the section B, in a same or substantially the same manner as the embodiment of FIG. 6. On the contrary, a voltage of the power voltage end N3 of the graph (b) does not drop down to a ground level GND but just to a voltage between a high level HIGH and a low level LOW. A voltage value after the section B which is a discharge section may be modified by adjusting a variable resistance of the circuit of FIG. 7.

As described above, according to the embodiment of the present invention as illustrated in FIGS. 7 and 8, a power voltage ELVDD that is optimized (or improved) by adjusting a voltage level of the power voltage end N3 may be implemented after discharging during a discharge section. In addition, after discharging is completed, a time period for charging the voltage of the power voltage end N3 down to a low level LOW may be reduced.

Figure 9:
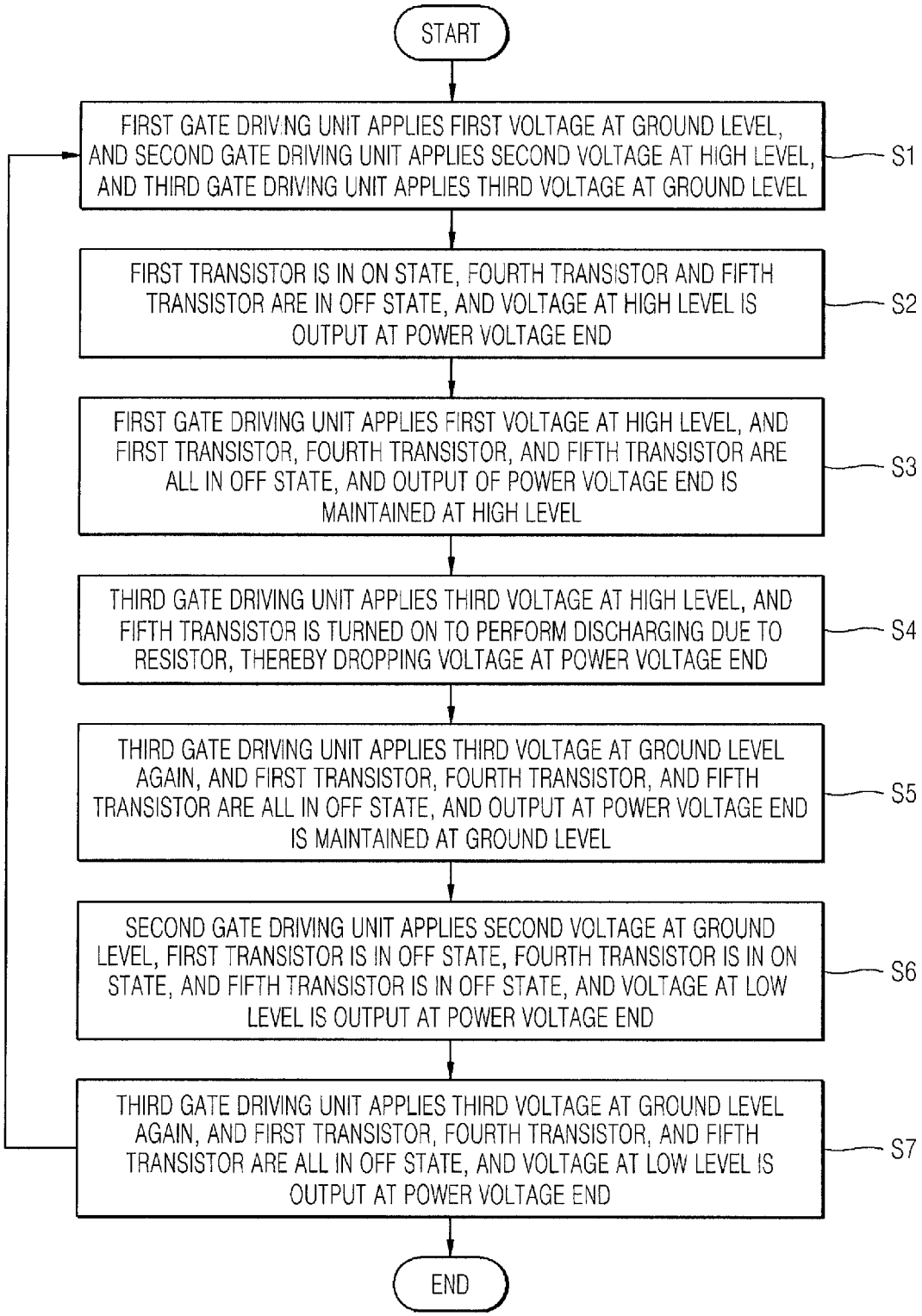
FIG. 9 is a flowchart of an operation of driving a circuit according to an embodiment of the present invention.

FIG. 9 is a flowchart of an operation of driving a circuit according to an embodiment of the present invention.

First, in an initial section (e.g., an initial period), the first gate driver 155*a* applies a first voltage V1 at a ground level GND, and the second gate driver 155*b* applies a second voltage V2 at a high level HIGH, and the third gate driver 155*c* applies a third voltage V3 at a ground level GND.

The first transistor M1 is in an ON state, and the fourth transistor M4 and the fifth transistor M5 are in an OFF state in operation S1, and a voltage at a high level HIGH is output to the power voltage end N3 in operation S2.

Next, the first gate driver 155*a* applies a first voltage V1 at a high level HIGH, and the first transistor M1, the fourth transistor M4, and the fifth transistor M5 are all in an OFF state, and an output of the power voltage end N3 maintains a high level HIGH in operation S3.

Next, in operation S4, the third gate driver 155*c* applies a third voltage V3 at a high level HIGH, and the fifth transistor M5 is turned on so as to perform discharging due to the resistor R (or the variable resistor R'), and thus a voltage value of the power voltage end N3 is dropped in operation S4.

Next, the third gate driver 155*c* applies a third voltage V3 again at a ground level GND, and the first transistor M1, the fourth transistor M4, and the fifth transistor M5 are all in an OFF state, and an output of the power voltage end N3 is maintained at a ground level GND in operation S5.

Next, the second gate driver 155*b* applies a second voltage V2 at a ground level GND, and the first transistor M1 is in an OFF state, and the fourth transistor M4 is in an ON state, and the fifth transistor M5 is in an OFF state, and a voltage at a low level LOW is output at the power voltage end N3 in operation S6.

Finally, the second gate driver 155*b* applies a second voltage V2 at a high level HIGH, and the first transistor M1, the fourth transistor M4, and the fifth transistor M5 are all in an OFF state, and an output at the power voltage end N3 is maintained at a low level LOW in operation S7.

Then the method may return to S1 to repeat the entire operations.

As described above, according to the one or more of the above embodiments of the present invention, electrical characteristics of a display apparatus may be improved.

In addition, a power voltage generating apparatus according to the one or more of the above embodiments of the present invention may stably output a high voltage and a low voltage without damaging an internal circuit.

It should be understood that the example embodiments described herein should be considered in a descriptive sense only and not for purposes of limitation. Descriptions of features or aspects within each embodiment should typically be considered as available for other similar features or aspects in other embodiments.

While one or more embodiments of the present invention have been described with reference to the described embodiments disclosed in the specification and the drawings, it will be understood by those of ordinary skill in the art that various changes in form and details may be made therein without departing from the spirit and scope of the present invention as defined by the following claims and their equivalents.

What is claimed is:

1. A power voltage generating apparatus for supplying a power voltage to a plurality of pixel circuits of a display apparatus, the power voltage generating apparatus comprising:

a high voltage converter to generate a high voltage;

a low voltage converter to generate a low voltage;

a switching circuit to alternately output the high voltage and the low voltage at a power voltage terminal as the power voltage; and a discharging unit coupled to the power voltage terminal and configured to discharge the power voltage terminal in a discharge period before the switching circuit changes the power voltage from the high voltage to the low voltage, wherein the discharge period comprises a first period in which the discharging unit gradually discharges the high voltage to a discharge voltage at the power voltage terminal, and a second period after the first period in which a voltage of the power voltage terminal is maintained as the discharge voltage.

2. The power voltage generating apparatus of claim 1, wherein the discharging unit comprises:

a resistor coupled to the power voltage terminal;

a transistor coupled between the resistor and a ground; and a gate driver coupled to a gate electrode of the transistor.

3. The power voltage generating apparatus of claim 2, wherein the gate driver is configured to turn on the transistor for a period of time before the switching circuit converts an output voltage from the high voltage to the low voltage.

4. The power voltage generating apparatus of claim 3, wherein the discharge voltage is a ground level which is lower than the low voltage.

5. The power voltage generating apparatus of claim 3, wherein the discharge voltage has a voltage level which is between the high voltage and the low voltage.

6. The power voltage generating apparatus of claim 2, wherein the transistor comprises an NMOS transistor.

7. The power voltage generating apparatus of claim 2, wherein the resistor comprises a variable resistor.

8. The power voltage generating apparatus of claim 2, wherein the gate driver is configured to turn on the transistor for the first period and to turn off the transistor for the second period.

9. The power voltage generating apparatus of claim 1, wherein the switching circuit comprises:

first and second transistors coupled between the high voltage converter and the power voltage terminal;

third and fourth transistors coupled between the low voltage converter and the power voltage terminal;

a first gate driver to apply a first voltage to the first and second transistors; and a second gate driver to apply a second voltage to the third and fourth transistors.

10. The power voltage generating apparatus of claim 9, wherein each of the first, second, third, and fourth transistors comprises a PMOS transistor.

11. The power voltage generating apparatus of claim 9, wherein the switching circuit is to output the high voltage at the power voltage terminal when the first gate driver turns on the first and second transistors, and the second gate driver turns off the third and fourth transistors, and the switching circuit is to output the low voltage at the power voltage terminal when the first gate driver turns off the first and second transistors, and the second gate driver turns on the third and fourth transistors.

12. A method of generating a power voltage supplied to a pixel unit of a display apparatus, the method comprising:

outputting a high voltage at a power voltage terminal, wherein the outputting is performed by a switching circuit, and a discharging unit coupled to the power voltage terminal is turned off;

discharging a voltage of the power voltage terminal as the discharging unit is turned on; and outputting a low voltage at the power voltage terminal, wherein the outputting is performed by the switching circuit, and the discharging unit is turned off, wherein the switching circuit alternately outputs the high voltage and the low voltage as a power voltage, and the discharging unit is coupled to the switching circuit, and wherein the discharging comprises:

gradually discharging the power voltage from high voltage to a discharge voltage at the power voltage terminal in a first period of a discharge period; and maintaining the discharge voltage at the power voltage terminal in a second period of the discharge period after the first period.

13. The method of claim 12, wherein the discharging unit comprises a resistor, a transistor coupled between the resistor and a ground, and a gate driver coupled to a gate electrode of the transistor, wherein when the transistor is turned on, the discharging unit is turned on, and when the transistor is turned off, the discharging unit is turned off.

14. The method of claim 13, wherein the resistor comprises a variable resistor, and a level of the discharging voltage and a time for changing the discharge voltage to the low voltage is varied according to a resistance value of the variable resistor.

15. The method of claim 12, wherein the switching circuit comprises:

first and second transistors coupled between a high voltage converter and the power voltage terminal; and third and fourth transistors coupled between a low voltage converter and the power voltage terminal.

16. The method of claim 15, wherein the outputting of the high voltage comprises:

turning on the first and second transistors while turning off the third and fourth transistors and the discharging unit; and maintaining the high voltage while turning off the first, second, third, and fourth transistors and the discharging unit.

17. The method of claim 15, wherein the outputting of the low voltage comprises:

turning off the first and second transistors and the discharging unit while turning on the third and fourth transistors; and maintaining the low voltage while turning off the first, second, third, and fourth transistors and the discharging unit.

18. The method of claim 15, wherein the discharging comprises:

turning off the first, second, third, and fourth transistors and turning on the discharging unit; and subsequently turning off the first, second, third, and fourth transistors and the discharging unit.

19. A display apparatus comprising:

a plurality of pixel circuits;

a data driver to generate a data driving signal to output the data driving signal to the plurality of pixel circuits;

a scanning driver to generate a scan signal to output the scan signal to the plurality of pixel circuits; and a power voltage generator to generate a power voltage and output the power voltage through a power voltage terminal to the plurality of pixel circuits, wherein the power voltage generator is to alternately output a high voltage and a low voltage at the power voltage terminal as the power voltage, and comprises a discharging unit to discharge the power voltage terminal in a discharge period before the power voltage is changed from the high voltage to the low voltage, wherein the power voltage generator gradually discharges the power voltage from the high voltage to a discharge voltage at the power voltage terminal in a first period of the discharge period, and maintains the discharge voltage at the power voltage terminal in a second period of the discharge period.

* * * * *